US006213147B1

(12) United States Patent
Gramann et al.

(10) Patent No.: US 6,213,147 B1
(45) Date of Patent: Apr. 10, 2001

(54) MAGNETIC SCREENING OF AN ACTURATOR FOR ELECTROMAGNETICALLY CONTROLLING A VALVE

(75) Inventors: Matthias Gramann, Neunkirchen; Gunther Breu, Nürnberg; Michael Nagel, Nürnberg; Roger Pohlmann, Nürnberg, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/348,759

(22) Filed: Jul. 7, 1999

(30) Foreign Application Priority Data

Jul. 7, 1998 (DE) ..... 198 30 233
Sep. 19, 1998 (DE) ..... 198 43 075

(51) Int. Cl.[7] ..... F16K 37/60
(52) U.S. Cl. ..... 137/554; 137/129.1; 123/90.11
(58) Field of Search ..... 137/554, 129.1; 123/90.11

(56) References Cited

U.S. PATENT DOCUMENTS 3,896,280 * 7/1975 Blake ..... 200/81.9 M
4,603,707 * 8/1986 Gregoire et al. .
4,619,288 * 10/1986 McPherson ..... 137/554
4,762,095 * 8/1988 Mezger et al. ..... 123/90.11
4,777,979 * 10/1988 Twerdochlib ..... 137/554
4,825,904 * 5/1989 Grau et al. ..... 137/554
4,914,388 * 4/1990 Kalista et al. ..... 324/207.16
5,101,856 * 4/1992 Kakinuma et al. ..... 137/554
5,111,092 * 5/1992 Reinicke ..... 310/68 B
5,144,977 * 9/1992 Eggerton et al. ..... 137/554
5,236,012 * 8/1993 Lin ..... 137/554
5,257,014 * 10/1993 Zimmermann ..... 340/686
5,311,903 * 5/1994 Poulin ..... 137/554
5,522,414 * 6/1996 Reeves ..... 137/1
5,575,309 * 11/1996 Connell ..... 137/556
5,769,043 6/1998 Nitkiewicz .
5,787,915 * 8/1998 Byers et al. ..... 137/1
5,975,131 * 11/1999 Theisen et al. ..... 137/554

FOREIGN PATENT DOCUMENTS 0 867 602 A1 9/1998 (EP) .

* cited by examiner

*Primary Examiner*—A. Michael Chambers
*Assistant Examiner*—Thomas L. McShane
(74) *Attorney, Agent, or Firm*—Venable; Norman N. Kunitz

(57) ABSTRACT

An actuator for electromagnetically controlling a valve with a device comprising a magnetic field sensor and a magnetic field transmitter for determining the instantaneous position of a retaining plate, the magnetic field sensor and the magnetic field transmitter being surrounded by magnetic screening.

8 Claims, 1 Drawing Sheet

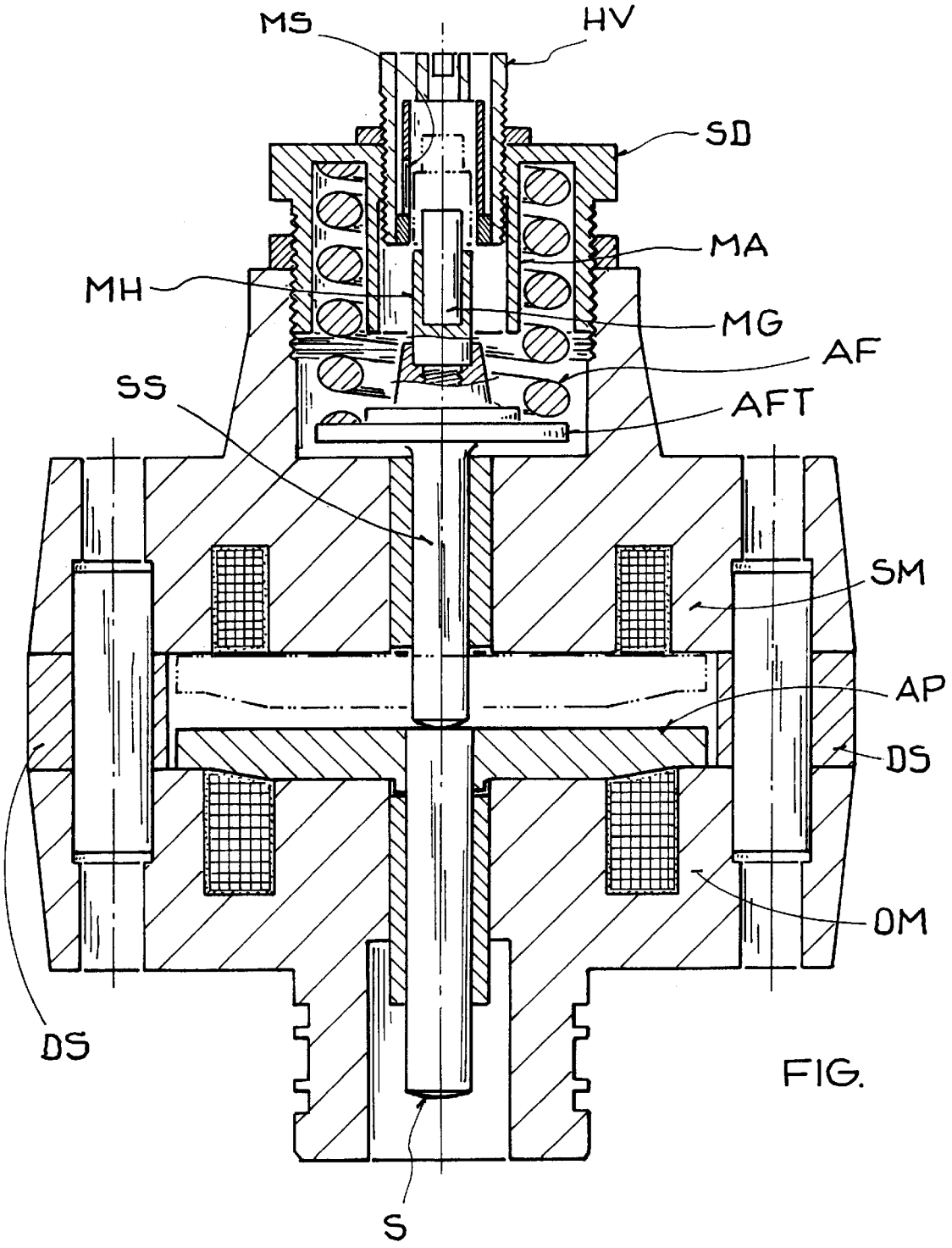
FIG.

MAGNETIC SCREENING OF AN ACTURATOR FOR ELECTROMAGNETICALLY CONTROLLING A VALVE

BACKGROUND OF THE INVENTION

The invention relates to an actuator for electromagnetically controlling a valve with a device for determining the position of the retaining plate. This device is made up of a magnetic field sensor and a magnetic field transmitter. Actuators of this kind for electromagnetically controlling a valve are known, for example, from U.S. Pat. No. 4,957,074.

An actuator for electromagnetically controlling a valve essentially comprises the closing magnet and the opening magnet which are separated from each other by at least one component of non-ferromagnetic material. This component can be in the form of a housing part, for example. Between the closing magnet and the opening magnet there is a retaining plate made of a ferromagnetic material that is moved when current flows through the operating coil of the opening magnet or the operating coil of the closing magnet in the respective direction. The yoke of the opening magnet has a bushing for a plunger which transfers the forces acting on the retaining plate to at least one gas change valve.

The actuator can be designed in such a way that, for example, the actuator spring is arranged on the side of the actuator that is opposite to the gas change valve and on the outside of the closing magnet. In the extension of the plunger, there is provided for this purpose a pushrod incorporating an actuator spring plate and mounted through a bushing in the yoke of the closing magnet. The yoke of the closing magnet has a formed shape that creates a wall around the bushing of the pushrod and in which an internal thread is provided. A screw cap is screwed into the internal thread of the wall forming, together with the wall, a hollow space in which the actuator spring that rests on the actuator spring plate is arranged. By turning the screw cap, the pretensioning of the actuator spring can be changed so that the rest position of the retaining plate can be adjusted.

An actuator and a gas change valve form a functional unit, where the gas change valve, as in a conventional cylinder head with camshafts, is pulled into the valve seat of the cylinder head by means of a valve spring and a valve spring plate.

When a functional unit comprising an actuator and a gas change valve has been mounted on the internal combustion engine, the valve stem of the gas change valve, the plunger and the pushrod of the actuator are pressed against each other. In the rest position of the functional unit, the retaining plate is precisely in the middle between the opening magnet and the closing magnet, the valve spring and the actuator spring being pretensioned. The valve plate of the gas change valve is in the mid-position between the valve seat of the cylinder head, at which the gas change valve is closed, and the position in which the gas change valve is fully open.

When an actuator is used to electromagnetically control a valve, it is of fundamental importance that the opening magnet and the closing magnet be operated at exactly the correct time with a precisely measured current. To provide these parameters, each actuator has a device for determining the position of the retaining plate that supplies to the control electronics assigned to the actuators a signal that is proportional to the position of the retaining plate. The device comprises, for example, a stationary magnetic field sensor attached to the yoke of the closing magnet and a magnetic field transmitter fitted to the oscillating pushrod. The control electronics calculates the current required to control the motion characteristics of the retaining plate on the basis of the magnetic field sensor signal, and also the times at which the opening magnet and the closing magnet are switched.

The magnetic field sensors sense the field strength of a magnetic field transmitter fitted to one of the oscillating parts of the actuator. A device of this kind for determining position is known from U.S. Pat. No. 4,957,074 named at the outset.

The disadvantage of this device for determining the position of the retaining plate is that the field line curve of the magnetic field transmitter is affected by the metallic parts of the actuator, some of which oscillate, such as for example the actuator spring.

SUMMARY OF THE INVENTION

The object of the invention is to specify an actuator for electromagnetically controlling a valve with a device having a magnetic field sensor and a magnetic field transmitter for determining the position of the retaining plate without the field line curve of the magnetic field transmitter being affected by the metallic and possibly oscillating parts of the actuator.

The above object is solved in accordance with the invention in that the magnetic field sensor and the magnetic field transmitter are surrounded by magnetic screening or shielding. Because of the magnetic screening, the magnetic field sensor only senses the field strength of the magnetic field transmitter which varies with the distance to the magnetic field transmitter.

The magnetic screening is preferably made of a material with soft magnetic properties, so that the field lines flow in the magnetic screening.

The magnetic field transmitter is attached at the end of the pushrod that has an actuator spring plate opposite to the retaining plate. The closing magnet has a formed shape with an internal thread forming a wall surrounding the bushing and into which a screw cap is screwed in. An actuator spring is arranged between the actuator spring plate and the screw cap. Between the actuator spring and the pushrod, to which the magnetic field transmitter is attached, a metal sleeve is arranged as magnetic screening, while the magnetic field sensor, which is securely attached to the closing magnet, is arranged between the metal sleeve and the pushrod at the magnetic field transmitter.

In an advantageous further development of the invention, it is provided that the magnetic screening in the form of a metal sleeve is a part of the screw cap, where the entire screw cap can possibly be made of a material with soft magnetic properties.

In another further development, it is provided that the magnetic field sensor is screwed into the screw cap with a holding device.

In a final advantageous further development, it is provided that the magnetic field sensor is designed as an analog Hall sensor and the magnetic field transmitter as a permanent magnet.

An actuator for electromagnetically controlling a valve with a device having a magnetic field sensor and a magnetic field transmitter for determining the position of the retaining plate which is surrounded by a magnetic screening will now be described and explained on the basis of an embodiment example and in conjunction with a FIGURE.

BRIEF DESCRIPTION OF THE DRAWING

The drawing shows:

FIGURE the schematic diagram of an actuator for electromagnetically controlling a valve with a device for determining the position of the retaining plate which is surrounded by a magnetic screening.

DESCRIPTION OF A PREFERRED EMBODIMENT

In the FIGURE, an actuator is shown for electromagnetically controlling a valve with a device for determining the position of the retaining plate AP which is made up of a magnetic field sensor MS, in the form of an analog Hall sensor, and a magnetic field transmitter MG, in the form of a permanent magnet.

The actuator consists of the yoke of the opening magnet ÖM and the yoke of the closing magnet SM which are separated from one another by two spacers DS made of a non-ferromagnetic material. Between the spacers DS, the retaining plate AP oscillates and to which is attached the plunger S that transmits to a gas change valve the forces acting on the retaining plate AP through a bushing in the yoke of the opening magnet ÖM.

In the extension of the plunger S there rests on the retaining plate AP a pushrod SS which is mounted in a bushing in the yoke of the closing magnet SM and which transmits the forces acting on the retaining plate AP to the actuator spring AF. For this purpose, there is on the end of the pushrod SS opposite to the retaining plate AP an actuator spring plate AFT on which the actuator spring AF rests and via which the actuator spring AF presses the pushrod SS against the retaining plate AP. On the side of the actuator spring plate AFT, an axial thread is provided in the pushrod SS into which a magnet holder MH is screwed in to hold the permanent magnet MG.

The actuator spring AF is located in a radial-symmetric formed shape of the yoke of the closing magnet SM that creates a wall around the bushing of the pushrod SS. On the inner side, the wall has a thread into which the screw cap SD is screwed in. The pretensioning of the actuator spring AF can be varied by means of the screw cap SD and this allows the non-loaded position of the retaining plate AP to be set.

The screw cap SD has in the center a central recess which is also provided with an internal thread. The recess is extended in a tubular form. This tubular extension provides the magnetic screening MA in the form of a metal screen for the permanent magnet MG fastened at the end of the pushrod SS. The screw cap SD and the metal sleeve MA are each made as a single part and therefore the whole screw cap SD is made of a material with soft magnetic properties.

A holding device HV is screwed into the internal thread of the central recess of the screw cap DS for the analog Hall sensor MS. Because of the screw-on design of the holding device HV, the position of the analog Hall sensor MS can be adjusted with respect to the permanent magnet MG. This adjustment is necessary when the mid-position of the retaining plate has been changed by turning the screw cap SD thereby also changing the position of the analog Hall sensor MS to the permanent magnet MG. The electrical wiring of the analog Hall sensor MS is also effected through the holding device HV.

Through the magnetic screening MA, which is part of the screw cap SD, the analog Hall sensor MS only senses the magnetic field strength of the permanent magnet MG, which varies with the distance between the analog Hall sensor and the permanent magnet MG, thus making available to a control unit assigned to the actuators an undistorted signal proportional to the position of the retaining plate AP.

What is claimed is:

1. Actuator for electromagnetically controlling a valve with an opening magnet (OM) and a closing magnet (SM) between which a retaining plate (AP) oscillates, with a device having a magnetic field sensor (MS) and a magnetic field transmitter (MG) for determining the instantaneous position of the retaining plate (AP), wherein the magnetic field transmitter (MG) and the magnetic field sensor (MS) are surrounded by a magnetic screening (MA).

2. Actuator in accordance with claim 1, wherein the magnetic screening (MA) is made of a material with soft magnetic properties.

3. Actuator in accordance with claim 1, wherein a plunger (S) is attached to the retaining plate (AP), and wherein in an extension of the plunger (S) a pushrod (SS) with an actuator spring plate (AFT) is arranged that oscillates with the retaining plate (AP) and to which the permanent magnet (MG) is fastened, and which is mounted in a bushing in the closing magnet (SM), and wherein the closing magnetic (SM) has a formed shape with an internal thread forming a wall surrounding the bushing and into which a screw cap (SD) is screwed, and wherein between the actuator spring plate (AFT) and the screw cap (SD) an actuator spring (AF) is arranged, and wherein between the actuator spring (AF) and the pushrod (SS) a metal sleeve is arranged as the magnetic screening (MA), and finally wherein between the metal sleeve and a portion of the pushrod (SS) on which the magnetic field transmitter (MG) is mounted, the magnetic field sensor (MS) is arranged and securely attached to the closing magnet (SM).

4. Actuator in accordance with claim 3, wherein the magnetic screening (MA) in the form of a metal sleeve is part of the screw cap (SD).

5. Actuator in accordance with claim 4, wherein the magnetic field sensor (MS) is screwed into the screw cap (SD) with a holding device.

6. Actuator in accordance with claim 2, wherein the magnetic field sensor (MS) is an analog Hall sensor and the magnetic field transmitter (MG) is a permanent magnet.

7. An actuator for electro-magnetically controlling a valve, with the actuator including an opening magnet and a closing magnet spaced from one another, a ferromagnetic retaining plate disposed between the opening and closing magnets and mounted for oscillating movement between the opening and closing magnets, to control the opening and closing of the valve; a magnetic field transmitter mounted for movement with the retaining plate; a magnetic field sensor mounted to sense the magnetic field produced by the magnetic field transmitter and for producing an electrical output signal proportional to the instantaneous sensed magnetic field and thus of the instantaneous position of the retaining plate; and a magnetic screen surrounding the magnetic field transmitter and the magnetic field sensor.

8. An actuator according to claim 7 wherein the magnetic field transmitter is a permanent magnet and the magnet screen is a metal sleeve enclosing the magnet and the magnetic field sensor, and formed of a soft magnetic material.

* * * * *